United States Patent [19]

Allen, Sr.

[11] Patent Number: 4,487,418

[45] Date of Patent: Dec. 11, 1984

[54] EDUCATIONAL GAME DEVICE

[76] Inventor: Earl E. Allen, Sr., 7683 Cambridge, Houston, Tex. 77054

[21] Appl. No.: 605,481

[22] Filed: Apr. 30, 1984

[51] Int. Cl.[3] ..... A63F 3/00; A63F 9/18; G09B 3/02

[52] U.S. Cl. ..... 273/242; 434/348; 434/404

[58] Field of Search ..... 273/141 R, 141 A, 242, 273/1 R; 434/348, 349, 404

[56] References Cited

U.S. PATENT DOCUMENTS

| | | | |
|---|---|---|---|
| 601,383 | 3/1898 | Reuter | 273/141 R UX |
| 1,346,929 | 7/1920 | Zion | 434/348 |
| 1,513,500 | 10/1924 | Greig | 273/141 R |
| 2,098,003 | 11/1937 | Hassenfeld | 434/348 |
| 2,560,647 | 7/1951 | Higgins | 434/404 |
| 2,902,775 | 9/1959 | Arrowsmith et al. | 273/141 R UX |
| 3,135,515 | 6/1964 | Kinsey | 273/141 R |
| 3,146,531 | 9/1964 | Whitney | 434/348 |
| 3,545,758 | 12/1970 | Payne, Jr. | 273/141 R X |
| 3,751,826 | 8/1973 | Kunert | 434/349 |
| 4,389,193 | 6/1983 | Phillips | 434/404 X |

FOREIGN PATENT DOCUMENTS

| | | | |
|---|---|---|---|
| 934994 | 1/1948 | France | 434/404 |

*Primary Examiner*—Paul E. Shapiro

*Attorney, Agent, or Firm*—David A. Rose; Ned L. Conley; William E. Shull

[57] ABSTRACT

An educational apparatus is disclosed including a base, a question/answer disc, a cover disc and a pointer all disposed on a post screw stacked from bottom to top in the order listed. The base displays a circle of numbered question/answer blocks which may be seen around the question/answer disc. The question/answer disc displays radial question/answer segments corresponding to the numbers in the question/answer blocks on the base. The question/answer segments are divided radially into a single question subsegment and a single answer subsegment. The cover disc has a window through which to view a single question displayed radially within the question subsegment. After the answer to the question has been attempted, the window in the cover disc is moved clockwise to reveal the correct answer in the answer subsegment. This answer is compared with the attempted answer. The question/answer discs are exchangeable. The apparatus may be used by a single person or may be used to play a competitive multiplayer game.

23 Claims, 10 Drawing Figures

Fig. 2A
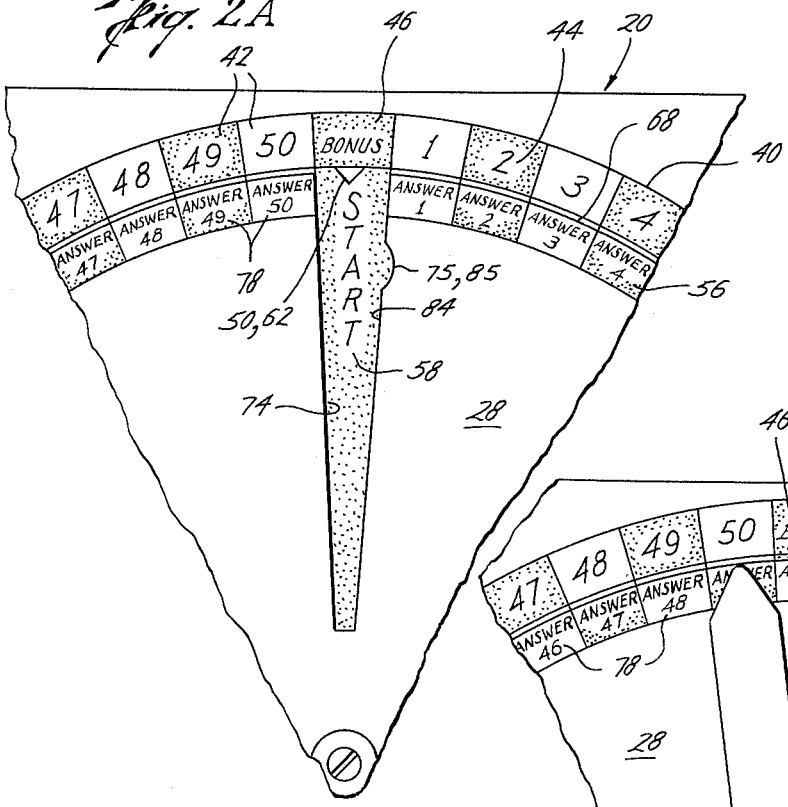
Fig. 2B
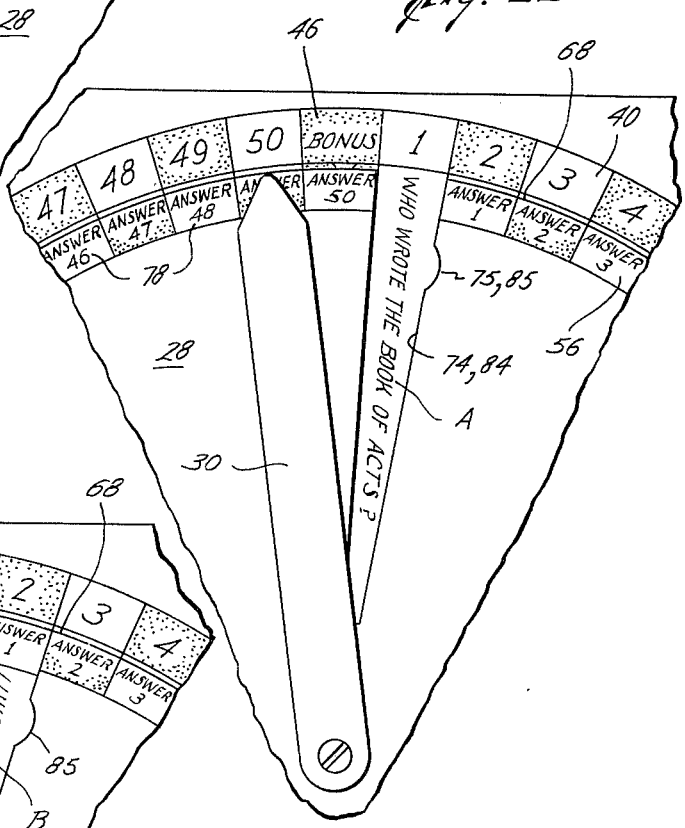
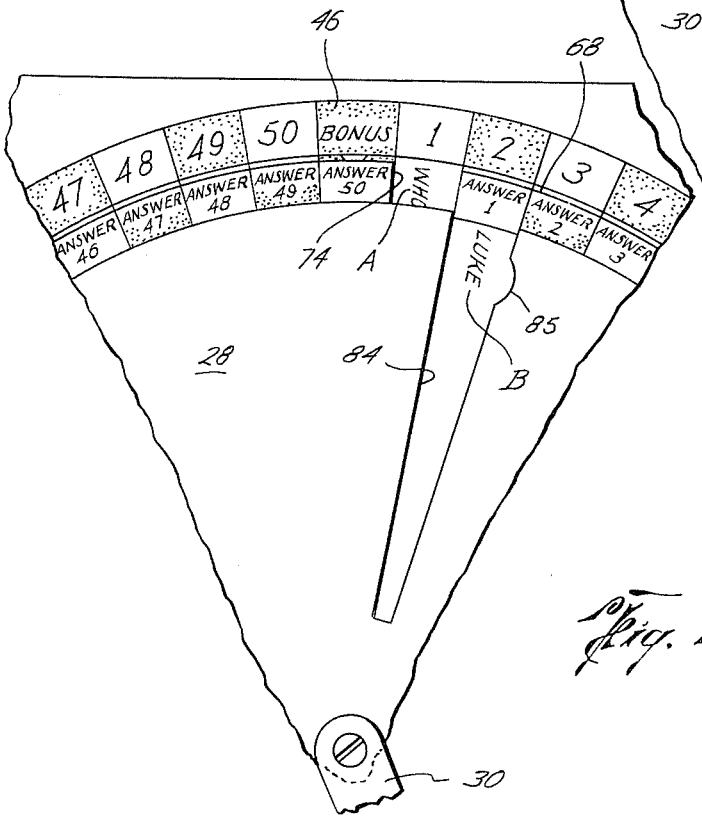
Fig. 2C

EDUCATIONAL GAME DEVICE

BACKGROUND OF THE INVENTION

This invention relates to new and useful improvements in educational game apparatus and more particularly to educational games with questions and answers displayed on discs such that, after an attempt is made to answer a question, the answer may be checked from the disc.

Educational games with question and answer "discs" are well known in the art. Some prior art educational games include windows through which answers may be viewed. For example, U.S. Pat. No. 2,098,003 to Hassenfeld includes front and back panels with a dial card therebetween and a pointer in fixed relation with the dial card. The front panel displays a circle with questions contained in radial sections of the circle. One of the radial sections is cut out to create a window through which the dial card may be viewed. When the pointer is placed over a radial section containing a question, the dial card turns in relation to the pointer such that the answer corresponding to the question selected is displayed through the window on the front panel.

Other examples of educational games include U.S. Pat. No. 2,560,647 to Higgins, which includes a primary disc, a secondary disc of lesser diameter rotatably disposed on the primary disc, and a cover segment rotatably disposed between the primary and secondary disc. The primary disc has "subjects," e.g. pictures of various birds, displayed around its outer perimeter, just beyond the edge of the secondary disc. The secondary disc includes four questions to be asked about each of the subjects. The questions are displayed radially on the secondary disc in counterclockwise order within printed squares. The secondary disc has an index arrow at its perimeter for alignment with a particular subject about which the four questions are to be asked. Answers to each of the four questions about each subject are disposed radially in clockwise order opposite to the questions on the primary disc and are covered beneath the secondary disc. The secondary disc has radial windows located opposite to the questions such that when the index arrow is aligned with a subject, the answers to the questions about that subject are positioned beneath the windows of the secondary disc. The secondary disc also has a semicircular slot below the questions and near the center of the disc. The cover segment includes a pointer extending through the semicircular slot of the secondary disc and is dimensioned so as to reveal the answers as the pointer is moved. When the pointer points to a question, that portion of the cover disc at a 180° angle from the pointer moves clockwise to reveal the answer to that question through the respective window in the secondary disc.

U.S. Pat. No. 3,751,826 to Kunert includes a bottom plate, rotating disc, program sheet, swing arm, and cover plate. The program sheet lies on the rotating disc and displays questions through a window in the cover plate. The answers are displayed through the window beside the questions, and a blank area is displayed radially outside the questions and answers through the window. A projection of the cover plate extends from the bottom of the window between the question and the blank area on the program sheet to cover the correct answer. An answer to the displayed question is attempted and may be written in the blank area outside the question, then the rotating disc with program sheet may be moved counterclockwise to expose the correct answer and reveal the next question with the next answer remaining concealed. When the disc and program sheet are moved counterclockwise, an eraser mounted on the swing arm, which is located counterclockwise above the blank area exposed by the window, erases the attempted answer to the previous question.

U.S. Pat. No. 1,617,831 to Wolke discloses a casing and an inner panel. The inner panel is spun and as the spinning slows, words and pictures randomly appear through the windows in the top of the casing.

Past educational games have been deficient in that they are complicated to operate and are expensive to manufacture. Further, prior art games are limited in the number of questions which may be asked and therefore tend to lack variety.

Other objects and advantages of the invention will appear from the following description.

SUMMARY OF THE INVENTION

The game apparatus of the present invention includes a base, a question disc, an answer disc, a cover disc, and a pointer. A post screw passes through a common aperture in the discs to attach the discs and pointer onto the base from bottom to top in the order listed.

The base has a circular border with a display composed of numbered question blocks and two blocks, 180° apart, marked BONUS. The word START is radially displayed below one of the bonus blocks on the base.

The question disc is disposed on top of the base. The diameter of the question disc equals the inside diameter of the circular border on the base so that the numbered question blocks are visible. Each side of the question disc is divided into equally spaced radial question segments having a width at their outer edge equal to the inner width of the numbered question blocks on the base. Each of the numbered question segments displays a single question printed radially inside the segment. Onee segment includes the word "START" and another segment identifies which side of the question disc is displayed. When the start segment is placed adjacent to the bonus block over the word START on the base, each question on the question disc will have an identifying number just above it. The question disc is fixed in this position by inserting a tab on the base within a notch in the periphery of the question disc.

The answer disc has the same diameter as the question disc and is mounted over the question disc. Each side of the answer disc is divided into equally spaced radial answer segments—one answer segment for each question segment on the question disc. A border of answer blocks is disposed on the answer disc outside the answer segments. A window is cut out of one of the answer segments and the segment 180° opposite to the window identifies which side of the answer disc is displayed. The rest of the answer segments on the answer disc display a single answer to a question on the question disc, the number, which is displayed beside the answer in the answer block, bearing the same number as the number on the base indicating a particular question on the question disc.

The cover disc is mounted over the answer disc to cover the answers. The cover disc includes a window which is the same size as the window in the answer disc.

The pointer has an aperture for the post screw and is mounted on the cover disc.

A scoring device may accompany the game apparatus for use in keeping score.

In operation, a numbered question is selected by spinning the pointer and the windows of the answer and cover discs are aligned with the numbered question block to reveal the question. An answer is attempted. The answer is checked by moving the window in the cover disc to the number above the answer segment corresponding to the number above the question to reveal the answer. Points are scored upon correctly answering a question with the score being recorded on the scoring device.

BRIEF DESCRIPTION OF THE DRAWINGS

For a detailed description of a preferred embodiment of the invention, reference will now be made to the accompanying drawings wherein:

FIG. 2 is a partial top view of the embodiment in FIG. 1 showing these phases of operation: (2A) the start position; (2B) the question position; and (2C) the answer position.

DESCRIPTION OF THE PREFERRED EMBODIMENTS

Figure 1:
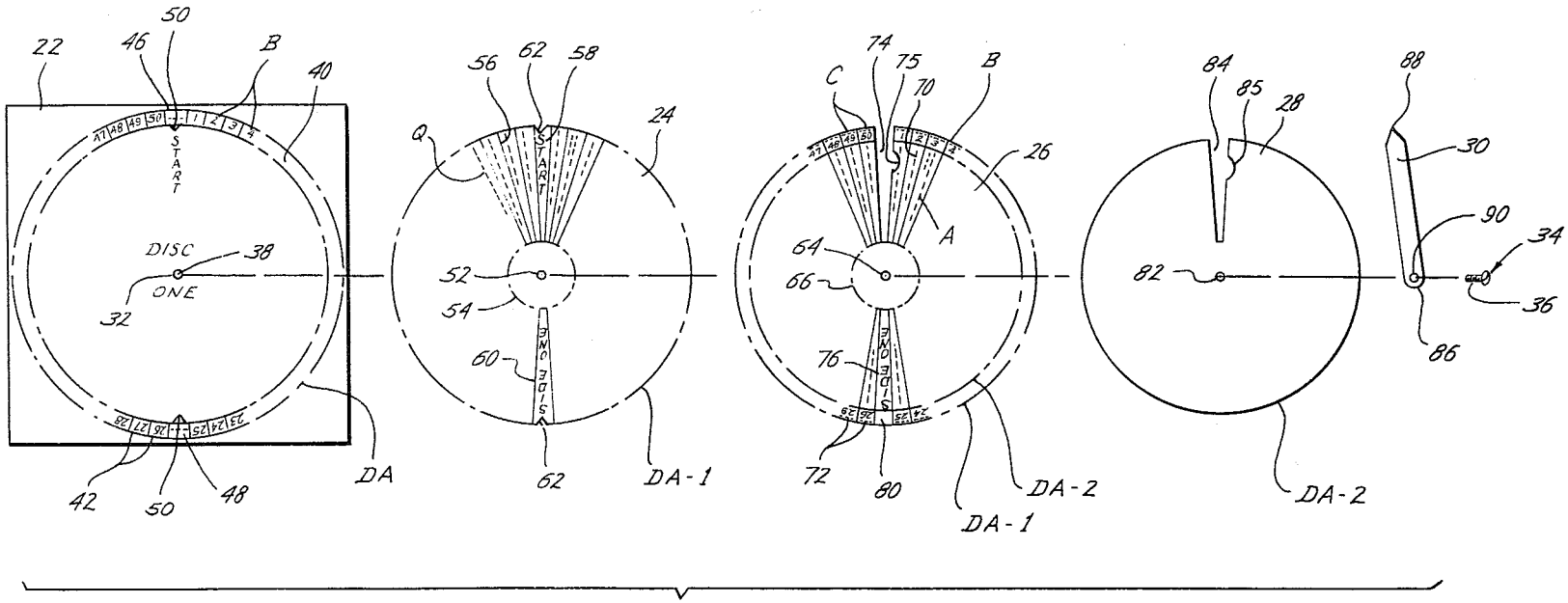
FIG. 1 is an exploded top view of one embodiment of the invention showing the base, question disc, answer disc, cover disc and pointer.

Referring initially to FIG. 1, game apparatus 20 of the present invention is shown to be a programmable device including a base 22, a question disc 24, an answer disc 26, a cover disc 28 and a pointer 30.

Base 22 serves to anchor the other discs and permits the question and answer discs 24, 26 to be turned over or replaced with other discs having additional questions and answers. Base 22 is generally rectangular and is made of reinforced cardboard with a thin transparent plastic covering. A central aperture 32 is provided at its center to receive a post screw 34 to attach the other discs as hereinafter described.

Game apparatus 20 is held together by any suitable means, as for example, the plastic post screw 34 shown in FIG. 1. Post screw 34 includes a plastic block 36 having a threaded pin and a larger diameter head, and a plastic nut 38 with a threaded bore and a larger diameter head. The larger diameter heads clamp the assembly together upon the engagement of nut 38 and bolt 36.

A circular border 40, divided into rectangularly shaped question blocks 42, is printed on base 22. The internal diameter of circular border 40 is substantially the same as the outer diameter of discs 24, 26, 28 whereby circular border 40 and question blocks 42 are visible after game apparatus 20 is assembled. All of question blocks 42 are numbered sequentially by question numbers B except for two question blocks 46, 48 which are marked with the word "BONUS". Bonus blocks 46, 48 are located opposite to each other on circular border 40 of base 22 and thereby divide circular border 40 into two halves—each half having an equal group of sequential question numbers B. In this embodiment, question numbers B are numbered 1 to 50 with those question numbers B between bonus blocks 46, 48 being sequentially numbered 1 to 25 and those question numbers B between bonus blocks 48, 46 being sequentially numbered 26 to 50. As shown best in FIG. 2, question blocks 42 are alternately shaded with every other question block 42, starting with bonus blocks 46, 48, being shaded gray. The remaining alternate question blocks 42 are white. Below bonus block 46 between the question blocks 42 numbered 50 and 1, is printed the word "START" extending radially toward the center of base 22. The words "DISC ONE" are printed at the center of base 22.

Projections or tabs 50 are disposed on base 22 just below bonus blocks 46, 48 and project outwardly the thickness of question disc 24 to engage and hold question disc 24 in place as hereinafter described.

Question disc 24 includes the questions, marked "Q" on FIG. 1, for game apparatus 20 and has two sides, each with different sets of questions Q on each side. The question sets may be on different subjects. The sides of question disc 24 are labeled "SIDE ONE" and "SIDE TWO" to differentiate between sides. Question disc 24 has an outer diameter substantially equal to the inner diameter of circular border 40 of base 22 and is made of a double-layered poster board covered on both sides by a thin layer of transparent plastic. Question disc 24 is disposed on top of base 22 and includes a center hole 52 for receiving post screw 34. A subcircle 54 is printed around center hole 52 on both sides of question disc 24 and inside subcircle 54 are displayed the words "DISC TWO" indicating the order of assembly of game apparatus 20.

Question disc 24 is divided into fifty-two equal radial, generally pie-shaped question segments 56, one for each of the fifty-two question blocks 42 around circular border 40 of base 22. Question segments 56 extend radially from subcircle 54 to the outer periphery of question disc 24. The width of each question segment 56 at the periphery is equal to and corresponds to the width of the internal edge of a question block 42 on circular border 40. Thus, each question segment 56 corresponds to and identifies with a particular numbered question block 42 on base 22.

Two of the question segments 56 have the words "START" (start segment 58) and either the words "SIDE ONE" or "SIDE TWO" (side segment 60) printed therein with the other fifty question segments 56 each having a different question Q printed therein. The words and questions are printed such that they start from the outer periphery of question disc 24 and extend toward subcircle 54. Start segment 58 and side segment 60 have the words "START" and either the words "SIDE ONE" or "SIDE TWO" positioned on question disc 24 in 180° opposition to one another so as to correspond with bonus blocks 46, 48 on base 22 upon assembly. The words "SIDE ONE" and "SIDE TWO" designate which question set of question disc 24 is being viewed. Start segment 58 is aligned with bonus block 46 on base 22, which has the word "START" printed therebelow for aligning question disc 24 with base 22. The other fifty question segments 56 having questions Q will each correspond to and be identified with one of the fifty sequentially numbered question numbers B on base 22. Each question number B within a question block 42 will thus indicate a single question Q in a question segment 56 on question disc 24. Question segments 56 are correspondingly shaded with question blocks 42 in an alternate fashion so as to match upon assembly.

Question disc 24 has notches 62 at its periphery adjacent to start segment 58 and side segment 60 for engagement with projections or tabs 50 on base 22 to maintain question disc 24 in programmed alignment with base 22. As will be hereinafter discussed, it is necessary that the proper question Q be numbered appropriately so as to correspond to the right answer A on answer disc 26. When game apparatus 20 is programmed by placing question disc 24 on top of base 22 and start segment 58 adjacent to bonus block 46, notches 62 receive tabs 50, the questions Q are properly numbered by question numbers B, and the alternate shading of question segments 56 and question block 42 match.

No identifying numbers are displayed around question disc 24; however, an alternate embodiment could include circular borders of identifying numbers around the edge of question disc 24. In this alternate embodiment, question disc 24 would not necessarily need to be in a fixed relation to base 22, so projections 50 and notches 62 would be optional.

Answer disc 26 displays the answers, marked "A", to the questions Q on question disc 24 for game apparatus 20 and has two sides, each with a set of answers A to questions Q corresponding thereto on sides one and two of question disc 24. The sides of answer disc 26 are also labeled "SIDE ONE" and "SIDE TWO" to correspond with the related sides of question disc 24. Answer disc 26 has the same diameter as question disc 24 and is also made of double-layered poster board covered on both sides by transparent plastic. Answer disc 26 is adapted to be disposed on top of question disc 24 and has a central aperture 64 for receiving post screw 34. A subcircle 66 is printed around central aperture 64 on both sides of answer disc 26 and within subcircle 66 are displayed the words "DISC THREE" to indicate the order of assembly.

Answer disc 26 displays a circular border 68 around its outer periphery and is divided into fifty-two equal radial, generally pie-shaped answer segments 70. Answer segments 70 extend radially from subcircle 66 to the inner periphery of circular border 68. The printed lines for answer segments 70 extend through circular border 68 to form answer blocks 72 which align with question blocks 42 of base 22 and have an outer width equal to the width of the inner edge of question blocks 42. Thus, each answer segment 70 and answer block 72 corresponds and identifies with a particular question number B on base 22.

Answer segments 70 correspond to question segments 56 and are dimensionally the same except that the outer portion of answer segments 70 has been reduced to include circular border 68 and answer blocks 72. That answer segment 70 which is to correspond to and align with start segment 58 on question disc 24 and bonus block 46 on base 22 has been cut out to form a slot or window 74 and has the same size as a single answer segment 70 and question segment 56. A finger groove or notch 75 is made into the outer edge of window 74 as a means to easily rotate answer disc 26 on post screw 34. When window 74 is programmed for alignment over a particular question Q on question disc 24, window 74 permits the question on question disc 24 to be viewed through answer disc 26. The answer segment 76 in 180° opposition to window 74 has printed either the words "SIDE ONE" or "SIDE TWO" to designate the answer side of answer disc 26 corresponding to the question side of question disc 24 being displayed. The other fifty answer segments 70 each include a single answer A to one of the individual questions Q on question disc 24. The words "SIDE ONE" and "SIDE TWO" and answers A are printed within answer segments 70 starting from the outer periphery of answer disc 26 and extending toward subcircle 66. Answer segments 70 are shaded to match the shading of question segments 56 and question blocks 42.

Answer blocks 74 display the word "ANSWER" and include answer numbers C sequentially numbered 1–50 with each number corresponding to an answer A for a correspondingly numbered question Q. The word "ANSWER" is circumferentially displayed adjacent to the outer edge of answer blocks 72 with the bottom of the word facing inward. The question numbers C are displayed below the word. The corresponding question and answer numbers B, C displayed on base 22 and answer disc 26, respectively, will be adjacent to each other when game apparatus 20 is programmed with bonus block 46, start segment 58 and window 74 in alignment. Answer block 80 between answer numbers B numbered 25 and 26 is blank and shaded to conform with side segment 60 and bonus block 48.

Cover disc 28 covers the answers A on answer disc 26 and is made of double-layered poster board covered by transparent plastic. Cover disc 28 has the same diameter as the inner diameter of circular border 68 on answer disc 26 and includes an aperture 82 to receive post screw 34. Cover disc 28 has a generally pie-shaped window 84 which is the same size as the question or answer segments 56, 70. Window 84 has its inner side a distance from aperture 82 equal to the radius of subcircles 54 and 66 and a finger groove or notch 85 to easily rotate cover disc 28 on post screw 34. Window 84 may be used to view an answer A from answer disc 26 when aligned with a particular answer segment 70 or to view a question Q from question disc 24 when aligned with window 74.

Pointer 30 is composed of plastic and has a rounded end 86, a pointed end 88 and an aperture 90 therethrough to receive post screw 34. The length of pointer 30 from aperture 90 to point 88 is equal to the radius of answer disc 26 and therefore equal to the radius of the inner edge of circular border 40 on base 22. Pointer 30 is rotatably mounted on post screw 34 so that it can be spun to point to a particular numbered question Q indicated by a question number B.

Game apparatus 20 is assembled by inserting the nut of post screw 34 into central aperture 32 of base 22. Question disc 24 is then disposed on base 22 with center hole 52 of question disc 24 receiving nut 38 of post screw 34. Question disc 24 is aligned with start segment 58 adjacent to bonus segment 46 on base 22, and notches 62 on question disc 24 are engaged with tabs 50 on base 22. This programming assures that questions Q on question disc 24 are properly numbered by numbers 1–50 in question blocks 42. The shading of question segments 56 thus corresponds to the shading of question blocks 42 bearing question numbers B. Question disc 24 should be checked to see whether the proper side segment 60 is displayed. Answer disc 26 should be oriented, with the same side as question disc 24 being displayed, and placed over question disc 24 by extending the nut 38 of post screw 34 through central aperture 64. Initially, window 74 is aligned over start segment 58, start segment 58 being visible through window 74. The shading of answer segments 70 should correspond to the shading of the surrounding question numbers B. Cover disc 28 is then engaged by placing nut 38 through aperture 82 with window 84 initially being aligned with window 74 on answer disc 26 so that start segment 62 is still visible. Pointer 30 may then be engaged by extending nut 38 through aperture 90, after which threaded bolt 36 of post screw 34 is engaged with the threads of nut 38. Answer disc 26, cover disc 28 and pointer 30 are freely rotatable around post screw 34 independently of base 22 and question disc 24.

Referring now to FIGS. 2A, 2B, and 2C illustrating the operation of game apparatus 20, game apparatus 20 is shown assembled and programmed, windows 74, 84 being aligned over start segment 58 which is aligned adjacent to bonus segment 46 between question blocks 42 numbered 1 and 50. Circular border 40 on base 22 is visible around the outer edges of question disc 24 and answer disc 26, and circular border 68 on answer disc 26 is visible around the outer edge of cover disc 28. Answer blocks 72 numbered 1 and 50 are adjacent to question blocks 42 numbered 1 and 50, respectively. The outer edge of cover disc 28 aligns with the inner edge of circular border 68 on answer disc 26. The outer edges of question disc 24 and answer disc 26 align with the inner edge of circular border 40 on base 22.

Referring now to FIG. 2B, if a question Q was selected randomly, pointer 30 has been spun and point 88 has stopped, for example, adjacent to the question block 42 marked with the number "1". Alternatively number "1" may have been deliberately selected. Windows 74, 84 are jointly moved to a position adjacent to question block 42 displaying the number "1". Answer block 72 marked "ANSWER 1" is now adjacent to question block 42 marked with the number "2", and answer block 72 marked "ANSWER 50" is now adjacent to bonus block 46. In this position both answer disc 26 and cover disc 28 cover all of the questions except the single question Q corresponding to the number "1" which is visible through windows 74, 84. The player then attempts to answer the question Q marked number "1".

Referring now to FIG. 2C, to check whether the correct response was given, window 84 in cover disc 28 is moved clockwise to a position adjacent to answer block 72 which displays the words "ANSWER 1". The answer A to the question Q marked number "1" is displayed through window 84 to be compared to the player's response.

Whenever the pointer 30 stops on either bonus block 46, 48, the person is entitled to spin the pointer 30 a predetermined number of additional consecutive times such as 5 and is given the chance to answer the additional questions, whether any of the questions are answered correctly or not.

Once this process has been completed, another question is selected and the process is repeated until every question on question disc 24 has been chosen or until the predetermined point total, such as 500 points, is attained, or until the discs are turned over or exchanged for replacement discs to change questions or subjects. Question disc 24 and answer disc 26 may be turned over to display the other side of questions, or a replacement question disc 24 and answer disc 26 may be disposed on base 22 to reprogram game apparatus 20.

Figure 3:
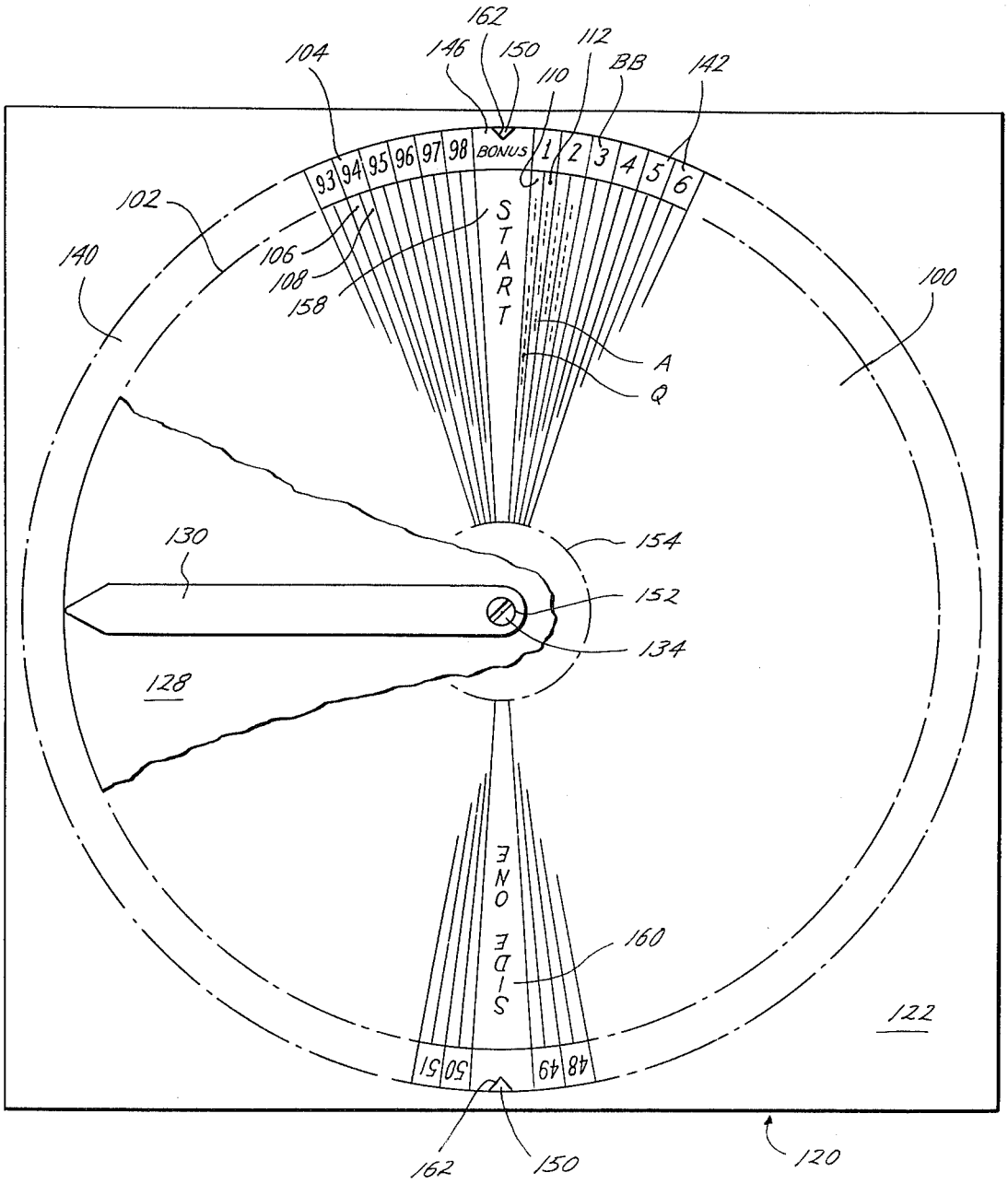
FIG. 3 is a top view of another embodiment of the invention showing a question/answer disc on the base.

Referring now to FIG. 3 illustrating another embodiment of the present invention, the game apparatus 120 includes a base 122, a question/answer disc 100, a cover disc 128, and a pointer 130. Pointer 130 of this embodiment is the same as pointer 30 of the first described embodiment and therefore no further description will be provided. Further, base 122 is the same as base 22 except that the question numbers BB in this embodiment are located on the question/answer disc 100 and sequentially numbered from 1 to 98 rather than from 1 to 50 as were question numbers B on base 22 of the first described embodiment. Where the features of this embodiment are substantially identical with those of the first described embodiment, no further description shall be provided and the numerical designations for those features shall be the number 100 added to the number designation of the same feature of the first described embodiment.

Question/answer disc 100 includes both the questions, marked "Q" on FIG. 3, and the answers, marked "A" on FIG. 3, and like question and answer discs 26, 28 of the first described embodiment, has two sides, each with different sets of questions and answers. As shown in FIG. 3, the sides of question/answer disc 100 are labeled "SIDE ONE" and "SIDE TWO" to differentiate the two sets of questions and answers. Question/answer disc 100 has an outer diameter sized to be conveniently disposed on base 122 and is made of double-layered poster board covered on both sides with a thin layer of transparent plastic. Question/answer disc 100 is disposed on top of base 122 and includes a center hole 152 for receiving a post screw 134. A subcircle 154 is printed around center hole 152 on both sides of question/answer disc 100.

Question/answer disc 100 is divided into one hundred equal radial, generally pie-shaped question/answer segments 104, and, as distinguished from the first described embodiment, includes a circular border 140 at the outer periphery of question/answer disc 100 which is divided into one hundred question/answer blocks 142 around circular border 140 of disc 100 by segments 104. Each question/answer segment 104 is further divided into question subsegment 106 and anser subsegment 108. Question/answer segments 104, question subsegments 106, and answer subsegments 108 all extend radially from subcircle 154, through circular border 140, to the outer periphery of question/answer disc 100. Together, question subsegments 106 and answer subsegments 108 have an outer width equal to the width of the inner edge of one of the question/answer blocks 142.

Two of the question/answer segments 104 have the words "START" (start segment 158) and either the words "SIDE ONE" or "SIDE TWO" (side segment 160) printed therein. The start and side segment 158, 160 have no question or answer subsegments 106, 108 and include the words "START" or "SIDE ONE" or "SIDE TWO" printed radially therein. As shown, start and side segments 158, 160 are opposite to each other on question/answer disc 100. The ninety-eight question/answer segments 104 each have one question Q and one answer A which correspond with one of the ninety-eight sequentially numbered question numbers BB on circular border 140 of base 122. Each question number BB thus indicates a single question Q in question subsegment 106 and the answer A to the question Q in answer subsegment 108. Question/answer segments 104 are correspondingly shaded or colored with question/answer blocks 142.

Question/answer disc 100 has notches 162 for engagement with tabs 150 on base 122 to hold question/answer disc 100 in place on base 122.

Questions Q and Answers A are printed radially in question and answer subsegments 106, 108 respectively, extending from the outer periphery of question/answer disc 100 toward subcircle 154. Thus, questions Q in question subsegment 106 always appear on the left one-half of question/answer segment 104 and the corresponding answer A in answer subsegment 108 appears on the right one-half of question/answer segment 104.

Figure 4A:
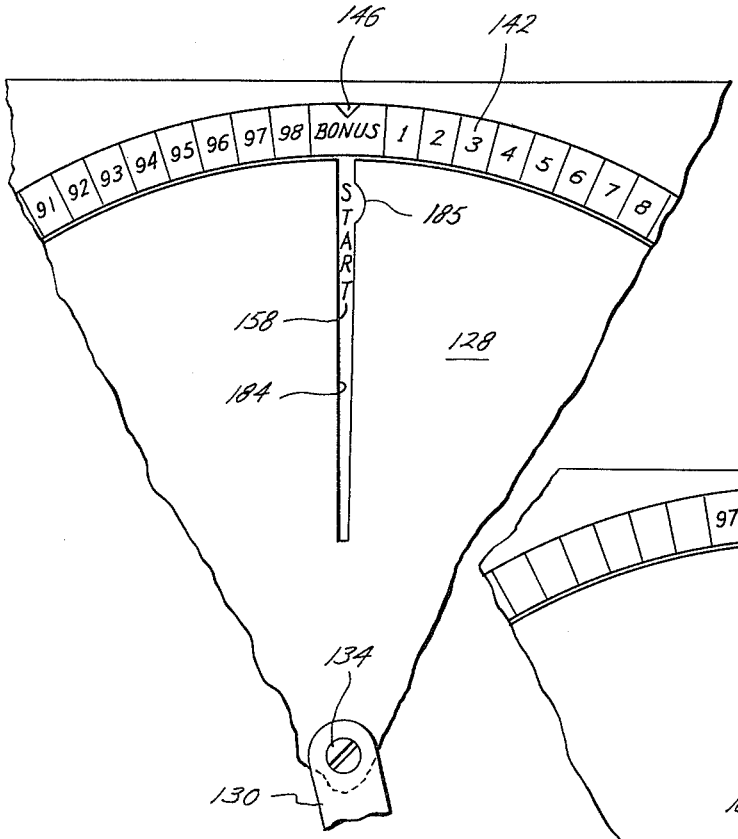
FIG. 4 is a partial top view of the embodiment of FIG. 3 showing three phases of operation: (4A) the start position; (4B) the question position; and (4C) the answer position.

Cover disc 128 of this embodiment differ from cover disc 28 of the first described embodiment in that the width of window 184, best shown in FIG. 4A, in cover disc 128 is equal to one-half the width of question/answer segments 104 and therefore one-half the width of question/answer blocks 142 on base 122. Also, the diameter of cover dics 128 is equal to the inner diameter of circular border 140 on question/answer disc 100. Window 184 also includes a finger groove or notch 185 for rotating cover disc 128 on post screw 134.

Game apparatus 20 is programmed in the same manner as the first described embodiment, the only difference being that only one program disc with questions and answers is involved, rather than two. Therefore, only 3 parts are disposed on post screw 134 atop base 122: question/answer disc 100, cover disc 128 and pointer 130. Start segment 158 is once again positioned adjacent to bonus segment 146 and notches 162 are engaged with tabs 150 from base 122.

Referring now to FIG. 4A of FIG. 4 illustrating the operation of this embodiment of the present invention, window 184 is positioned adjacent to bonus segment 146 on base 122 to reveal start segment 158 on question-/answer disc 100.

Figure 4B:
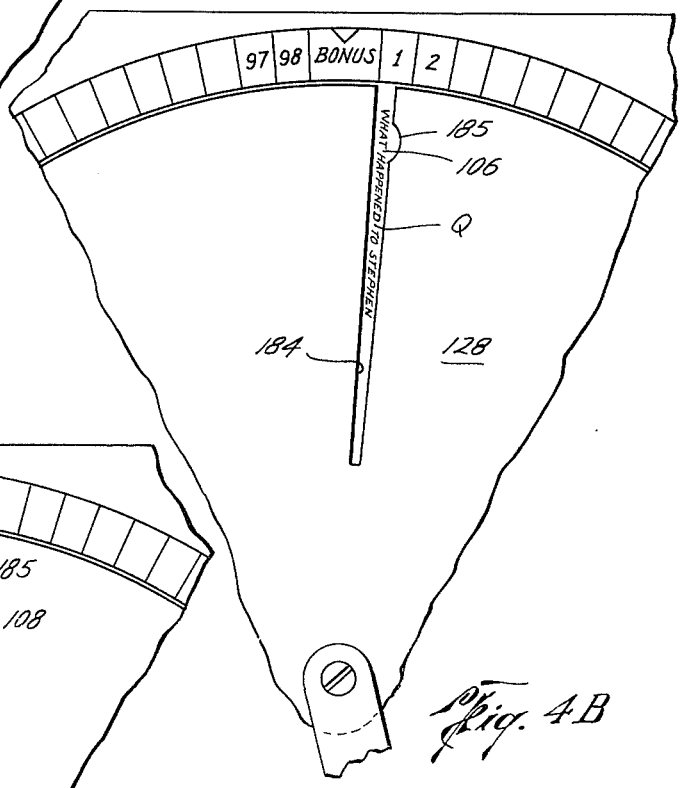

Referring now to FIG. 4B, question Q, identified as question "1" by question/answer block 142 marked number "1" has been chosen, either by spinning pointer 130 or by deliberate selection. Window 184 in cover disc 128 is positioned over question subsegment 106 at the left half of question/answer segment 104 to reveal a single question Q numbered "1". The outer edge of window 184 is adjacent to the left half of the question-/answer block 142 marked number "1".

Figure 4C:
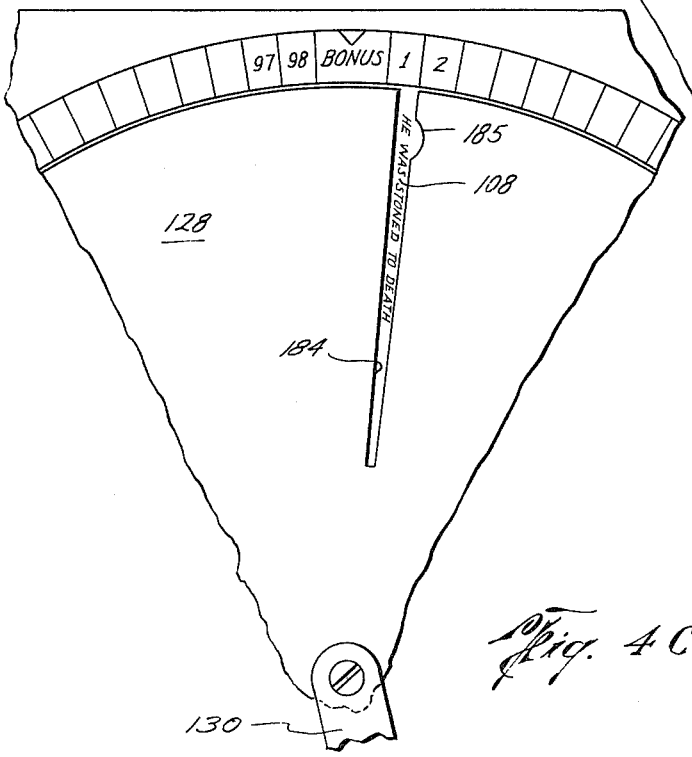

Referring now to FIG. 4C, after the player has attempted to answer question Q, window 184 is positioned over answer subsegment 108 at the right side of question/answer segment 104 to reveal correct answer A to question number "1". The outer edge of window 184 is adjacent to the right half of question/answer block 142 marked number "1".

Question and answer discs 24, 26 of the first described embodiment and question/answer disc 100 of the last described embodiment are designed to be removable so that they may be replaced by other discs to vary the subject matter of the questions of game apparatus 20 and the discs are programmed on both sides for maximum efficiency and lowest cost. Game apparatus 20 may present instructional materials in a variety of graphic forms (i.e., written, pictorial, statistical, mathematical, etc.) and though a particular form has been referred to, this does not limit application of the invention to one form. Game apparatus 20 may be used by children and/or adults and may be used, first, as a learning device by which one person attempts to answer questions Q in numerical order and then compares his own answers to the correct answer A. Second, game apparatus 20 may be used to play an educational quiz game in which two or more players compete. To play the educational quiz game, each participant spins the pointer 30, 130 until each participant has a different number B, BB. The person with the largest number goes first and the rest of the players follow according to who has the highest number. The person with the smallest number should serve as a non-competing monitor. If the pointer stops on a line between two numbers, the number to the right of the line should be used. Each player, in numerical order, spins the pointer 30, 130 and answers the questions Q which are selected until an incorrect answer is given. The monitor checks the players' answers with the correct answer A and, if the player answers correctly, marks a scoring device, shows in FIG. 5, giving 20 points for each correct answer. When an incorrect answer is given, the next player tries, etc., until one of the players wins by reaching a score of 500.

Figure 5A:
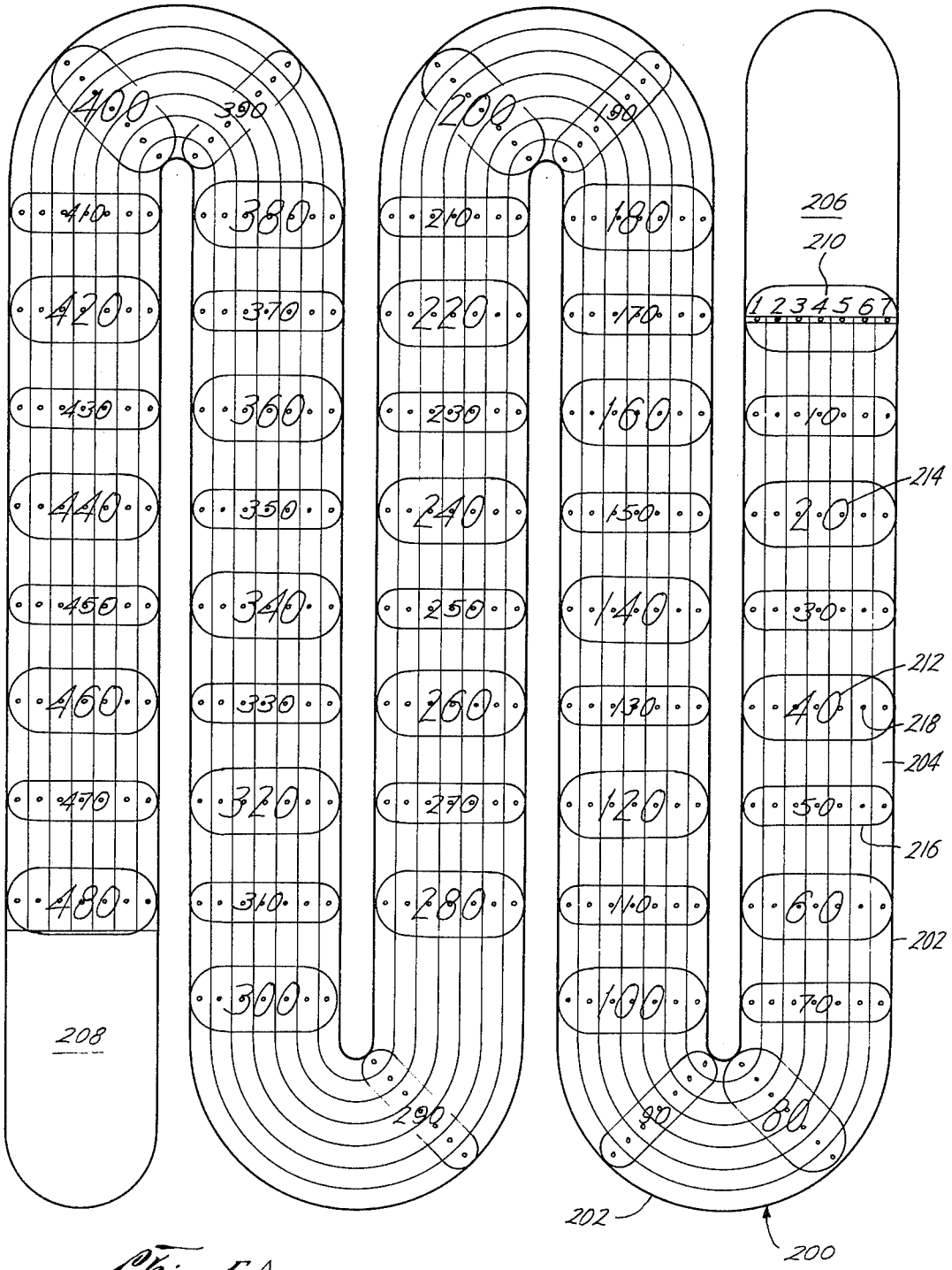
FIG. 5A is a top view of the scoring device which may be used with the above embodiments and FIG. 5B is an elevation view of the scoring peg used with the scoring device.
Figure 5B:
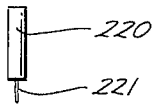

Referring now to FIGS. 5A and 5B illustrating scoring device 200, scoring device 200 includes a track 202 consisting of a series of continuous S-curves. Track 202 includes continuous lanes 204 therearound extending from the start position 206 to the finish position 208. In the preferred embodiment there are seven lanes. Lanes 204 are distinguished from each other by each having distinguishing colors. Each of the lanes 204 is marked with a player or team number 210 near the start position 206. Track 202, and thus lanes 204, are marked with scoring positions 212. Scoring positions 212 include multiples of 20 points 214, and intermediate multiples of ten points 216, the first digit of said intermediate scoring positions 216 being an odd number. Each of the lanes 204 at scoring positions 212 include a hole 218 to receive the shaft 221 of a marker or scoring peg 220 shown in FIG. 5B. Holes 218 are also provided at the start position 206. Pegs 220 are initially received within holes 218 at numbers 210 of start position 206 and then are moved to scoring positions 212 as points are scored in the answering of questions.

Before the scoring device 200 is used, each of the players or teams is assigned one of the lanes 204 at starting position 206, beginning with lane 1 and thereafter assigned in the numerical order determined by the players or teams spinning pointer 30. Each player or team is also given a colored peg 220 having the same color as the assigned lane. Each peg 220 is then placed in the appropriate hole 218 at the start position. When a player answers a question correctly, the monitor places the colored peg 220 in the hole 218 representing the total number of points that have been accumulated by that player or team. Points are accumulated by moving the pegs 220 from scoring position to scoring position until a predetermined number of points are accumulated, such as 500 points, at which time the first player accumulating such points becomes the winner.

For teams of players to use the game apparatus and scoring device, each team is assigned a lane on the scoring device 200 and the order of rotation of play among the teams is determined by spinning pointer 30. In starting play, the team captain spins pointer 30 and the team captain is given the chance to answer the indicated question. The monitor checks to see if the question has been answered correctly, and if so, gives that team 20 points. If the team captain cannot himself answer the question and requests assistance from the team members, the team will receive 10 points. To mark the new score on the scoring device 200, the monitor adds the additional points to the team's score and moves scoring peg 220 to the appropriate scoring position 214 or 216. If the question was answered successfully, the game apparatus is then passed to the next team member who spins the pointer and attempts to answer a new question. As long as the members of a team answer the questions correctly, the game apparatus is passed among the team members and points are accumulated on scoring device 200. When a question is answered incorrectly, the game apparatus is passed to the captain of the opposing team who follows the above procedure. The first team reaching 500 points wins.

While preferred embodiments of the invention have been shown and described, many modifications thereof can be made by one skilled in the art without departing from the spirit of the invention. Therefore, it should be understood that the details set forth herein are for illustration only, and are not intended to limit the scope of the invention as set forth in the following claims.

I claim:

1. An educational apparatus comprising:

a base having a border with a plurality of question numbers therearound;

a question disc sized for mounting within said border on said base, said question disc being divided radially into a plurality of question segments, each of said question segments having a question printed therein, said questions being uniquely numbered by said question numbers;

an answer disc rotatably mounted on said base over said question disc and sized to cover said questions, said answer disc having a plurality of answer numbers around its periphery and being further divided radially into a plurality of answer segments, each of said answer segments having an answer printed thereon to one of said questions, said answers being uniquely numbered by said answer numbers to correspond to said numbered questions, said answer disc having a first window for viewing a selected one of said questions through said answer disc;

a cover disc rotatably mounted on said base over said answer disc and sized to cover said answers, said cover disc having a second window for alignment with said first window to view said selected question and for alignment with said answer number on said answer disc to view the numbered answer to said selected question;

means for securing said discs to said base; and means for fixing said question disc with respect to said base to provide proper alignment between said question numbers and questions.

2. The apparatus of claim 1 wherein said question disc, answer disc, and cover disc are circular, said question and answer discs having the same diameter and said cover disc having a smaller diameter so as to expose said answer numbers on said answer disc after assembly.

3. The apparatus of claim 1 wherein said question disc includes question segments and questions on each side thereof and said answer disc includes answer segments and answers on each side thereof.

4. The apparatus of claim 3 wherein each side of said question and answer discs are individually marked to differentiate between the set of questions and answers on one side from the set of questions and answers on the other side.

5. The apparatus of claim 1 wherein said base, question disc, and answer disc are individually marked to designate the order of assembly thereof.

6. The apparatus of claim 1 further including replacement question discs and replacement answer discs for exchanging with said question and answer discs.

7. The apparatus of claim 1 wherein said questions and answers are printed radially inwardly extending from the periphery of said question and answer discs to the center thereof.

8. The apparatus of claim 1 further including a scoring device to keep track of the questions answered correctly, said device including:

a track having a plurality of lanes;

said track having a start position and a finish position;

said track having scoring positions marked with numbers, said numbers identifying the number of points accumulated by answering a question correctly.

9. An educational apparatus comprising:

a question/answer disc having a border with a plurality of question/answer numbers therearound said question/answer disc being divided radially into a plurality of question/answer segments, each of said question/answer segments being subdivided into a question subsegment and an answer subsegment, each of said question subsegments having a question printed therein and each of said answer subsegments having an answer to said question in said question/answer segment printed therein, said questions and answers being numbered by said question/answer numbers;

a cover disc rotatably mounted over said question/answer disc and sized to cover said questions and answers, said cover disc having a window to view said selected question and then to align with and view said corresponding answer through said cover disc; and means for rotatably mounting said question/answer disc and said cover disc.

10. The apparatus of claim 9 further including a pointer rotatably mounted on said cover disc and having a radial length equal to the width of said question disc.

11. The apparatus of claim 9 wherein said mounting means includes a post screw passing through common apertures in said base and discs, said cover disc being rotatably mounted on said post screw for rotation on said question/answer disc.

12. The apparatus of claim 9 further including at least one bonus position between two of said question/answer numbers on said question/answer disc.

13. The apparatus of claim 9 further including a base, said question/answer disc being sized for mounting on said base.

14. The apparatus of claim 13 further including means for holding said question/answer disc in place on said base, said holding means including at least one projection on said base engaging at least one notch in said question/answer disc.

15. The apparatus of claim 9 wherein said question/answer disc includes question and answer subsegments and questions and answers on each side thereof.

16. The apparatus of claim 9 wherein said question subsegments and answer subsegments are alternately colored.

17. The apparatus of claim 9 further including replacement question/answer discs for exchanging with said question/answer discs.

18. The apparatus of claim 9 wherein said questions and answers are printed radially inwardly extending from the periphery of said question/answer disc to the center thereof.

19. An educational apparatus comprising:

a base having a circular border thereon which is sectioned radially into ninety-eight equally sized question blocks each having an inner edge and an outer edge, said circular border having two bonus blocks in 180° opposition being marked with the word "BONUS" and separating said circular border into two halves, said question blocks marked with numbers 1–49 forming one-half of said circular border and said question blocks marked with numbers 50–98 forming said other half of said circular border between said bonus segments, one of said bonus segments being a start position having the word "START" written inward radially from said inner edge of said bonus segment, said bonus segments having variant colors and each alternate question block therefrom also having such variant colors, said base having a central aperture and having the words "DISC ONE" displayed near said central aperture;

a question/answer disc sized for mounting within said circular border on said base, said question/answer disc having an outer edge and a central aperture with a subcircle inscribed around said central aperture and the words "DISC TWO" displayed within said subcircle, said question/answer disc being divided radially on both sides into one hundred equally sized question/answer segments, said question/answer disc having a start segment displaying the word "START" written inward radially from said outer edge of said question/answer disc and having a side segment in 180° opposition to said start segment displaying the words written inward radially from said outer edge of said question/answer disc designating a certain side of said question/answer disc, said radial question/answer segments having an inner end and an outer end, said outer end having the same width as said inner edge of one of said question blocks in said circular border on said base, said question/answer segments being divided into two equal subsegments, one subsegment being a question subsegment and one being an answer subsegment, said question subsegment displaying a single question written inward radially from said outer edge of said question/answer disc and said answer subsegment displaying an answer corresponding to said question written inward radially from said outer edge;

a cover disc rotatably mounted on said base over said question/answer disc to cover said questions and answers, said cover disc having a central aperture and having a window the size of a single question-/answer subsegment on said question/answer disc, said window extending to a distance from said central aperture equal to the radius of said subcircle on said question/answer disc;

a pointer rotatably mounted on said cover disc having a rounded end and a pointed end, having an aperture through said rounded end, said pointer having a radial length equal to the radius of said question/answer disc;

means for securing said discs and pointer to said base comprising a post screw passing through common apertures in said base and discs, said post screw having a nut and bolt, said bolt having a threaded pin and a larger diameter head, said nut having a cylinder and a larger diameter head, said cylinder being threaded at its interior to engage said threads of said pin, said larger diameter heads securing said base, question/answer disc and pointer therebetween; and means for fixing said question/answer disc with respect to said base comprising at least one projection on said base engaging at least one notch in said question/answer disc.

20. A method of playing an educational game, said game including a rotatable pointer, a question/answer disc with a circular border of question blocks displaying numbers which surround and number questions and their corresponding answers, said questions and answers displayed radially in radial segments on the circular question/answer disc, a cover disc covering said question/answer disc and having a window therethrough to view said questions and answers, comprising the steps of:

a. selecting a question number by spinning the pointer;
b. moving the window in the cover disc adjacent to the left half of the question/answer block displaying the number selected;
c. viewing the question through the window;
d. attempting an answer to the revealed question;
e. moving the window in the cover disc adjacent to the right half of the question block displaying the number selected; and
f. viewing the correct answer through the window and comparing said revealed answer to said attempted answer.

21. The method of playing an educational game as set forth in claim 20 further including the steps of:

a. tallying points in favor of the player or team for each correct answer given;
b. repeating steps a-g until an incorrect answer is given;
c. changing players or teams in selected order when an incorrect answer is given; and
d. repeating steps a-g until a predetermined total score is attained by one player or team, said player or team winning the game.

22. The method of playing an educational game as set forth in claim 20 wherein said order of players or teams is chosen by:

spinning the pointer to select one number for each player or team;

designating the player or team selecting the highest number as the first player or team, the player or team with each successively lower number being ordered sequentially;

designating the player selecting the lowest number as the neutral tallying monitor.

23. The method of playing an educational game as set forth in claim 20 wherein said game further includes a scoring device having a plurality of lanes with scoring positions, further including the steps of:

a. assigning a numbered lane to a player;
b. inserting peg into holes in the device at the start position;
c. advancing and inserting the peg in a hole located at the appropriate scoring position each time a correct answer is given;
d. repeating steps (a–c) until an incorrect answer is given; and
e. repeating steps (a–c) for each successive player until one player reaches a predetermined score, or reaches a finish position on the scoring device, that player winning the game.

* * * * *